United States Patent [19]

Rossmann et al.

[11] Patent Number: 4,492,522

[45] Date of Patent: Jan. 8, 1985

[54] BLADE FOR A FLUID FLOW ENGINE AND METHOD FOR MANUFACTURING THE BLADE

[75] Inventors: Axel Rossmann; Werner Huether, both of Karlsfeld, Fed. Rep. of Germany

[73] Assignee: MTU Motoren-und Turbinen-Union Muenchen GmbH, Munich, Fed. Rep. of Germany

[21] Appl. No.: 448,706

[22] Filed: Dec. 10, 1982

[30] Foreign Application Priority Data

Dec. 24, 1981 [DE] Fed. Rep. of Germany ..... 3151413

[51] Int. Cl.[3] ..... F01D 5/14

[52] U.S. Cl. ..... 416/241 R; 415/200; 415/212 R; 416/229 A; 416/241 B

[58] Field of Search ..... 415/200, 175, 212 R; 416/223 R, 224, 229 A, 241 R, 241 A, 241 B

[56] References Cited

U.S. PATENT DOCUMENTS

| | | | |
|---|---|---|---|
| 2,962,388 | 11/1960 | Ruppert et al. | 427/249 |
| 3,294,366 | 12/1966 | Coplin | 416/224 |
| 3,637,320 | 1/1972 | Wakefield et al. | 416/224 |
| 3,637,325 | 1/1972 | Morley | 416/224 |
| 3,699,623 | 10/1972 | Kreider | 416/230 |
| 3,911,188 | 10/1975 | Torti et al. | 416/229 A |
| 4,233,342 | 11/1980 | Aichert et al. | 416/241 R |
| 4,241,110 | 12/1980 | Ueda et al. | 416/241 B |
| 4,318,672 | 3/1982 | Hansen | 416/229 A |

FOREIGN PATENT DOCUMENTS

| | | | |
|---|---|---|---|
| 2107498 | 12/1972 | Fed. Rep. of Germany . | |
| 2517404 | 11/1975 | Fed. Rep. of Germany . | |
| 1306315 | 9/1962 | France | 416/229 A |
| 694170 | 6/1953 | United Kingdom | 416/229 A |

OTHER PUBLICATIONS

E. J. Stefanides, "Alpha SiC Ceramics Solves Heat, Wear Problems", 5-26-80, vol. 36, No. 10, pp. 114+115.

*Primary Examiner*—Samuel Scott
*Assistant Examiner*—B. J. Bowman
*Attorney, Agent, or Firm*—W. G. Fasse; D. H. Kane, Jr.

[57] ABSTRACT

A blade for a fluid flow engine, especially a gas turbine, has a protective coating against injurious attack by the propellant or working medium. A metal blade having a diffusion layer or a sprayed coating for inhibiting corrosion is known. Such coating renders the blade highly resistant against heavily erosive and corrosive attack, especially by pulverized coal combustion gas or similar agents. The present blade is made of ceramic material, especially a dense ceramic material with a surface layer of at least one of the following materials: TiN, TiC, $B_4C$, BN and titanium carbon nitride. These materials are easy to apply and provide a good bond with the ceramic material. If the ceramic materials are silicon carbide (SiC) or silicon nitride ($Si_3N_4$) an especially good bond is achieved. This coating strongly resists removal, as it does oxidation and heat. Local removal down to the ceramic material, as it may result from rather long service, is recognizable immediately. These coating materials can be applied to give adequate quality and satisfactory repeatability by using the known CVD (chemically vapor deposited) or the PVD (physical vapor deposited) process.

11 Claims, 4 Drawing Figures

FIG. 1
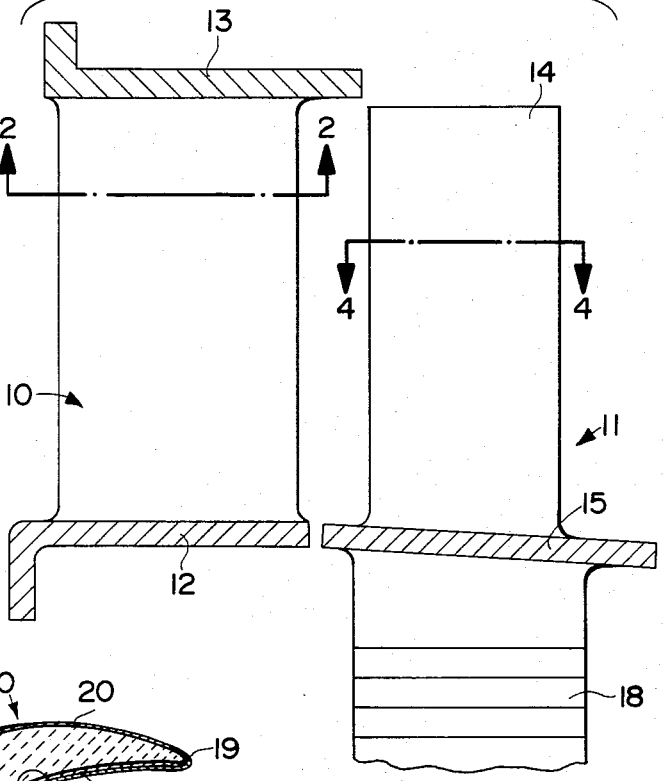
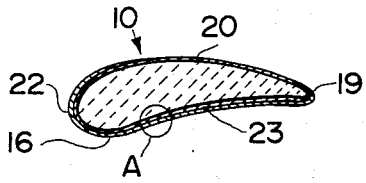
FIG. 2
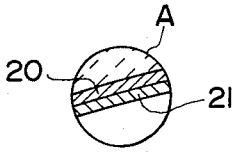
FIG. 3
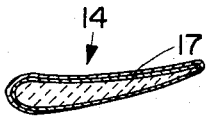
FIG. 4

BLADE FOR A FLUID FLOW ENGINE AND METHOD FOR MANUFACTURING THE BLADE

CLAIM TO PRIORITY

The present application corresponds to German Patent Application No. P 31 51 413.8-13, filed in the Federal Republic of Germany on Dec. 24, 1981. The priority of the German filing date is claimed for the present application.

BACKGROUND OF THE INVENTION

The invention relates to a blade for a fluid flow engine, particularly to the blades of a gas turbine. The invention also relates to a method for manufacturing such blades.

Gas turbine blades with a protective coating are known in the art. Such prior art blades are made of metal and the protective coating comprises primarily a diffusion layer made, for example of aluminum, chromium or platinum. Prior art protective coatings may be applied as a sprayed layer, for example made of cobalt, chromium, aluminum, yttrium or zirconium oxide ($ZrO_2$). These prior art protective layers serve as corrosion protection layers. Where zirconium oxide is used as the protection layer, the layer operates as a thermal insulation or thermal barrier. It is also known to apply organic or inorganic varnish or sprayed layers especially of tungsten carbide (WC) onto the surface of metal turbine blades to provide an erosion protection. It is further known to provide turbine blades with enamel coatings for damping blade vibrations.

The protective coatings of the prior art are primarily intended for a specific purpose such as heat insulation, corrosion prevention, or vibration damping. However, especially in connection with many gas turbines combined or simultaneous requirements must be satisfied by the protective coatings, for example, to counter the simultaneously occurring large erosion and corrosion effects on the blades. These combined load effects causing wear and tear in many gas turbines are very large where the fuel is an alternative fuel such as furnace gas, as compared to oil. The wear and tear effects are extremely large in gas turbines which are operated with a gas produced as an alternative fuel by the combustion of coal dust. Such coal dust fuel is loaded with solid particles which are entrained in the fuel flow and are therefore erosive as well as corrosive.

Currently, gas turbine blades are being tested which are made of ceramic materials. Such ceramic material turbine blades have been found to have good corrosion and erosion resistance as compared to gas turbine blades made of metal provided that the fuel gas is moderately corrosive. A material removal from the blades of ceramic material cannot be prevented, however.

OBJECTS OF THE INVENTION

In view of the above it is the aim of the invention to achieve the following objects singly or in combination:

to make ceramic turbine blades highly resistant against erosion and corrosion simultaneously to thereby minimize the material removal from the blades which may otherwise be caused by the erosion and corrosion attack;

to improve the erosion and corrosion resistance simultaneously even in those instances where the fuel or the working medium has a strongly eroding and corroding effect on the blade surfaces, especially where alternative fuel combustion gases are used, particularly in connection with coal dust combustion gases;

to cover the surfaces of ceramic gas turbine blades with single or multiple layer protective coatings of different thicknesses in different locations or zones of the blade surface; and to provide a method for manufacturing such protected ceramic turbine blades.

SUMMARY OF THE INVENTION

According to the invention there is provided a blade for a fluid flow engine such as a turbine, comprising a blade body made of ceramic material such as silicon carbide (SiC) and/or silicon nitride ($Si_3N_4$) provided with a protective coating on the external surface of the blade body. The protective coating is made of a coating material selected from the group consisting of titanium nitride (TiN), titanium carbide (TiC), and titanium carbon nitride.

According to the invention these protected turbine blades are manufactured by first producing a blade body of said ceramic material and then coating at least certain surface portions of the ceramic material blade body with a protective coating made of a coating material selected from the above listed group. The coating may be accomplished by a chemical vapor deposition process (CVD) or by a physical vapor deposition (PVD). The processes as such are known in the art.

The combination of a ceramic blade body with a coating of at least one of the four mentioned coating materials has been found to provide a good bonding between the coating and the ceramic body material. Even where highly erosive and corrosive working media or combustion gases are used, the material removal has been found to be small or very small. Thus, the blade is very little susceptible to attack even by a very erosive and corrosive operating medium. Surprisingly, the coating according to the invention is simultaneously highly resistant against material removal and mechanical wear and tear while also having good oxidation resistance, and heat resistance. Furthermore, the glossy gold color titanium nitride coating functions, among other advantages, also as a heat radiation reflector which has the surprising further advantage that the use up of cooling air is substantially reduced in connection with internally air cooled blades. Furthermore, any local removal of the protective coating after very prolonged running times is immediately recognizable because of the color and brightness difference between the dark or light ceramic on the one hand and the mentioned coating, whereby the ceramic becomes clearly visible. Thus, it becomes possible by means of a mere visual inspection of the blades installed in the engine to ascertain the size of the removed coating surface relative to the entire surface of the blade. Instead of a visual inspection, a boroscopic or endoscopic inspection may be employed to ascertain the degree of material removal from the blade or blades.

The mentioned advantages and effects of the invention are especially pronounced where alternative fuels are used, particularly where the mentioned coal dust gases are employed. Frequently, it is satisfactory to employ but a single layer comprising one of the four mentioned protective coating materials.

BRIEF FIGURE DESCRIPTION

In order that the invention may be clearly understood, it will now be described, by way of example, with reference to the accompanying drawings, wherein:

FIG. 1 is a sectional view of a portion of a fluid flow engine equipped with ceramic blades;

FIG. 2 is a sectional view along section line 2—2 in FIG. 1;

FIG. 3 is an enlarged view of a zone A in FIG. 2; and

FIG. 4 is a sectional view along section line 4—4 in FIG. 1.

DETAILED DESCRIPTION OF PREFERRED EXAMPLE EMBODIMENTS AND OF THE BEST MODE OF THE INVENTION

FIG. 1 shows a sectional view through a fluid flow engine such as a gas turbine, whereby the sectional plane extends through the axis of rotation. Only a fractional portion of a turbine is shown in a simplified manner. Thus, the stator body comprises a ring member 12 carrying a radially extending blade or vane 10 of ceramic material as mentioned above. The radially outer end end of the blade 10 is held in an annular member 13. The blade 10 functions as a guide vane. The rotor 11 comprises a radially extending blade portion 14 secured to a so-called blade platform 15 which in turn is carried by the blade root 18.

FIG. 2 shows a sectional view along section line 2—2 in FIG. 1 and illustrates how the surface of the ceramic blade 10 is provided with a protective coating 20 according to the invention. Such protective coating may be made of any one or a combination of the above four listed materials, namely, titanium nitride, titanium carbide, boron carbide, and/or titanium carbon nitride. For example, the layer 20 may cover the entire blade 10 including its leading edge 22, its trailing edge 19, its reduced pressure side or suction side at the top of the guide blade or vane and at its increased pressure side at the bottom 23 of the blade 10. Similarly, the blade 14 of the rotor shown in FIG. 4 is covered with a coating 17 which may also cover the suction side facing downwardly in FIG. 4 and the pressure side facing upwardly in FIG. 4. Generally, the pressure side may be provided with a thicker coating than the suction side as is shown in FIGS. 2 and 4. This thicker coating will be exposed to the respective radially outer flow of the medium flowing through the engine.

The coating portions 16 and 17 shown in FIGS. 2 and 4 comprise a first layer 20 as mentioned above which, for example is made of titanium carbide forming an inner layer in bonded contact with the surface of the ceramic blade and a second layer 21 forming an outer surface as best seen in FIG. 3 on an enlarged scale. The outer layer 21 is, for example, made of titanium nitride and is intimately bonded to the inner layer 20. The double layer reaches around the leading edge 20 and along the bottom 23 as well as around the trailing edge 19. The same applies to the illustration of FIG. 4, except the top coating is thicker.

It has been found that the bonding of the protective coating on the ceramic is best when the density of the ceramic is within the range of 95% to 99% of the maximum theoretical density. In other words, a better bond is achieved on dense ceramic materials than on porous ceramic materials. This is considered to be a surprising result because a better surface penetration would be expected on a porous surface.

Further, it has been found that the denser the ceramic material is, the higher will be its resistance to wear and tear as well as to erosion and corrosion. By employing a multi-layer coating, it is possible to achieve on the one hand a surprisingly good bond between the coating and the ceramic material, and to achieve on the other hand an especially high material removing resistance, especially in those exterior zones of the blade which are exposed to more wear and tear than other zones. However, good results have also been achieved with a coating comprising mixed materials of the above mentioned four materials or a coating of at least two separate layers which again are made of mixed materials. An especially good bond has been achieved on ceramic materials of silicon carbide (SiC) and/or silicon nitride ($Si_3N_4$).

By placing the protective coatings in those areas which are exposed most to wear and tear and erosion, or by making the protective coating thicker in those areas an especially good protection is achieved against material removal. Similarly, the best protection against material removal is achieved by placing the protective coating or thickening the protective coating in those areas which are exposed to the radially outer zone of the flow through a duct or space in which the blades are located.

The present coatings may be applied by a chemical vapor deposition (CVD) or by a physical vapor deposition (PVD). Both of these methods are known as such, whereby good quality bonds in a well repeatable manner are achieved between the dense ceramic material and the coating. A very strong bond has in fact been achieved.

In the present context, especially in connection with gas turbine fuels or working media obtained as an alternative fuel, particularly in the form of coal dust, the above mentioned material removal due to erosion and corrosion will primarily involve material removal by erosion. The term corrosion may include in this context an oxidation process. The present coatings have been found to be also very effective in connection with gas turbine working media comprising mixtures of a gas or a combustion gas or gases and air. The danger of oxidation is particularly caused by the air mixed with the fuel gas. However, the danger of corrosion may also be caused by the combustion gases or similar agents and/or by contaminants present in the combustion gas such as sulphur.

The invention is applicable in connection with guide vanes and/or with rotor blades. Primarily, the protective coating will be applied to the vane or blade. However, the protective coating may also be applied on the ring members or on the shrouds or similar parts of the guide vanes. In connection with the rotor blades the coating may be additionally applied, for example on other components, particularly the blade platform 15 and the blade root 18.

Although the invention has been described with reference to specific example embodiments, it will be appreciated, that it is intended to cover all modifications and equivalents within the scope of the appended claims.

What is claimed is:

1. A blade for a turbomachine, comprising a blade body made of a dense ceramic material selected from the group consisting of silicon carbide (SiC) and silicon nitride ($Si_3N_4$) and a protective coating on the external surface of said dense ceramic material blade body, said protective coating being made of a coating material selected from the group consisting of titanium nitride (TiN), titanium carbide (TiC), and titanium carbon nitride, whereby said blade has an improved resistance to both corrosion and erosion as compared to said blade without said protective coating.

2. The blade of claim 1, wherein said ceramic material of said blade body has a density within the range of 95% to 99% of the maximum theoretical density.

3. The blade of claim 1, wherein said protective coating comprises at least two superimposed layers each of which is made of at least one of said coating materials.

4. The blade of claim 1, wherein said ceramic material of said blade body is silicon carbide (SiC) and silicon nitride ($Si_3N_4$).

5. The blade of claim 1, wherein said protective coating has a nonuniform thickness at least in certain portions of the blade body surface, so that the protective coating is thicker in zones which are exposed to higher wear and tear.

6. The blade of claim 5, wherein said blade body has a leading edge, a trailing edge, a reduced pressure surface and an increased pressure surface, said protective coating being thicker on said leading edge and on said increased pressure surface than on said trailing edge and thicker than on said reduced pressure surface.

7. The blade of claim 1, wherein said protective coating covers only those zones of said blade body which are exposed to higher wear and tear.

8. The blade of claim 7, wherein said blade body has a leading edge, a trailing edge, a reduced pressure surface and an increased pressure surface, said protective coating being present substantially only on said leading edge and on said increased pressure surface.

9. The blade of claim 1, wherein said protective coating is thicker on those surface portions of the blade body which are exposed to radially outer zones of a fluid flow through said engine.

10. The blade of claim 1, wherein said protective coating comprises at least two superimposed layers of which the outer layer is thicker on those surface portions of the blade body which are exposed to radially outer zones of a fluid flow through said engine.

11. A blade for a turbomachine, comprising a blade body of a dense ceramic material and a protective coating on at least certain surface portions of said blade body, said protective coating being selected from the group consisting of titanium nitride, titanium carbide and titanium carbon nitride, said protective coating having been applied by chemical vapor deposition (CVD) or physical vapor deposition (PVD), whereby said blade has an improved resistance to both corrosion and erosion as compared to said blade without said protective coating.

* * * * *

UNITED STATES PATENT AND TRADEMARK OFFICE

CERTIFICATE OF CORRECTION

PATENT NO. : 4,492,522

DATED : January 8, 1985

INVENTOR(S) : Axel Rossmann, Werner Huether

It is certified that error appears in the above—identified patent and that said Letters Patent is hereby corrected as shown below:

Column 6,
Claim 11, line 2, after "material" insert --having a density within the range of 95% to 99% of the maximum theoretical density of said dense ceramic material--.

Signed and Sealed this

*Fifteenth* Day of *October 1985*

[SEAL]

*Attest:*

DONALD J. QUIGG

*Attesting Officer*

*Commissioner of Patents and Trademarks—Designate*